US006779969B2

(12) United States Patent
Nonaka et al.

(10) Patent No.: US 6,779,969 B2
(45) Date of Patent: Aug. 24, 2004

(54) VACUUM PUMP

(75) Inventors: Manabu Nonaka, Narashino (JP); Tooru Miwata, Narashino (JP); Takashi Kabasawa, Narashino (JP)

(73) Assignee: BOC Edwards Technologies Limited, Narashino (JP)

( * ) Notice: Subject to any disclaimer, the term of this patent is extended or adjusted under 35 U.S.C. 154(b) by 48 days.

(21) Appl. No.: 10/308,795

(22) Filed: Dec. 3, 2002

(65) Prior Publication Data

US 2003/0103842 A1 Jun. 5, 2003

(30) Foreign Application Priority Data

Dec. 4, 2001 (JP) ..... 2001-370618

(51) Int. Cl.[7] ..... F01D 1/36
(52) U.S. Cl. ..... 415/90; 415/143
(58) Field of Search ..... 415/90, 143, 170.1, 415/173.4; 417/423.4

(56) References Cited

U.S. PATENT DOCUMENTS

| | | | | |
|---|---|---|---|---|
| 5,116,196 A | | 5/1992 | Baret et al. | 415/89 |
| 5,893,702 A | | 4/1999 | Conrad et al. | 415/71 |
| 6,135,709 A | * | 10/2000 | Stones | 415/90 |

FOREIGN PATENT DOCUMENTS

| | | |
|---|---|---|
| EP | 0260733 | 3/1988 |

OTHER PUBLICATIONS

Patent Abstracts of Japan, vol. 1999, No. 13, Nov. 30, 1999 publication No. 11 210674 A (Ebara Corp), publication date Aug. 3, 1999.

Patent Abstracts of Japan, vol. 010, No. 346 (M–537), Nov. 21, 1986 publication No. 61 145394 A (Tokuda Seisakusho Ltd), publication date Jul. 3, 1986.

* cited by examiner

*Primary Examiner*—Edward K. Look
*Assistant Examiner*—Dwayne J. White
(74) *Attorney, Agent, or Firm*—Adams & Wilks

(57) ABSTRACT

A thread-groove pump mechanism portion PB employs a turn-back structure including a rotor formed of a multiple cylinder having an inner cylindrical rotor and an outer cylindrical rotor and a stator formed of a multiple cylinder having an inner cylindrical stator and on outer cylindrical stator. Gaps g1 and g3 defined by the outer walls of the rotor and the stator walls, and a gap g2 defined by the inner cylinder wall of the rotor and the stator wall during the rest of the pump are formed such that they increase with the distance from the rotor shaft center and g1>g2 and g1>g3 are satisfied. Thus, even if displacement occurs by the centrifugal force and thermal expansion during the operation of pump, predetermined gaps can be provided therebetween.

16 Claims, 5 Drawing Sheets g1 > g2 g1 > g3

$$\frac{g11+g12}{2} > \frac{g21+g22}{2}$$

$$\frac{g11+g12}{2} > \frac{g31+g32}{2}$$

g11 < g12
g21 > g22
g31 < g32

VACUUM PUMP

BACKGROUND OF THE INVENTION

1. Field of the Invention

The present invention relates to a vacuum pump used for a semiconductor manufacturing apparatus, an electron microscope, a surface analysis apparatus, a mass spectrograph, a particle accelerator, an atomic fusion experimental apparatus and so on, and more particularly, relates to a vacuum pump having a thread-groove pump mechanism portion for exhausting gas molecules by the interaction between a cylindrical surface of a rotor rotating at high speed and a fixed screw stator.

2. Description of the Related Art

In a process such as dry etching, chemical vapor deposition (CVD), or the like performed in a high-vacuum process chamber in semiconductor manufacturing step, a vacuum pump such as a turbo-molecular pump is used for producing a high vacuum in the process chamber by exhausting gas from the process chamber.

This type of turbo-molecular pump has a plurality of rotor blades on the outer periphery of a cylindrical rotor and a plurality of stator blades, which is located and fixed between the rotor blades, mounted in a pump case. The rotor is integrated with a rotor shaft. The turbo-molecular pump rotates the rotor shaft at high speed with a drive motor to thereby exhaust a gas sucked through a gas suction port to a lower gas discharge port by the interaction between the rotor blades rotating at high speed and the fixed stator blades, thereby evacuating the inside of the process chamber connected to the gas suction port to a high degree of vacuum.

Such a turbo-molecular pump has drawbacks in that when the backing pressure is increased to make the pressure of the rotor blades from a molecular flow pressure to a viscous flow pressure, the compressing efficiency of the rotor blades is rapidly decreased and the rotational resistance is increased to cause a significant decrease in performance and an increase in heat generation of the rotation body, and to increase in the power necessary for maintaining the rotation of the rotating body such as a rotor. Therefore, as a means for correcting the drawbacks, the turbo-molecular pump mechanism portion constituted by the rotor blades and the stator blades has a thread-groove pump mechanism portion including a cylindrical surface of the rotor and a thread groove at the back stage thereof, wherein the compressibility is increased by the interaction between the cylindrical surface of the rotor and the thread groove, so that the backing pressure of the rotor blades can be held low even when the backing pressure of the pump is increased; thus, a decrease in the compressibility of the whole pump is prevented.

In the compound-type turbo-molecular pumps having the thread-groove pump mechanism portion and the turbo-molecular pump mechanism portion, a uniform narrow gap is formed between the rotating body and the fixed body during the rest of the pump. Meanwhile, in a pressure region where the pressure is in an intermediate flow, when the mean free path of the molecules becomes less than a certain gap, a sealing effect of a small gap between the cylindrical surface of the rotating body and the thread groove rapidly decreases to reduce the compressing efficiency of the thread-groove pump mechanism portion, so that the gap is required to be set as small as possible.

However, because the gap during the rest of the pump is uniform, when the gap is set extremely narrow, the cylindrical rotating blades have a largest displacement due to a centrifugal force at the end of the cylinder when the pump is actually operated to rotate the rotating body of the rotor at high speed, so that the gap becomes small at the end of the cylinder and large at the opposite side thereof because of a stress applied to the blades during the operation of the pump.

The gap between the rotating body and the fixed body may be small at the end of the cylinder because of other external factors such as vibration from the exterior, thermal expansion due to an increase in the temperature of the rotating body, mechanical election tolerance, parts tolerance and so on, thus, causing a risk of contact between the rotating body and the fixed body at the end of the cylinder. A large gap at the opposite side thereof may decrease the sealing performance between the cylindrical surfaces of the rotating body and the fixed body to cause a significant decrease in the compressing efficiency of the thread-groove pump.

The present invention has been made to solve the above problems and the object thereof is to provide a highly-reliable vacuum pump capable of preventing a damage due to the contact between the cylinders of a high-speed rotating rotor and stators and preventing a decrease in the compressing efficiency of the pump by maintaining a sealing performance of them during the operation of the pump.

SUMMARY OF THE INVENTION

In order to achieve the above object, a vacuum pump according to the present invention comprises: a rotor shaft rotatably supported in a pump case having a gas suction port opened in the upper surface and a gas exhaust port opened in the lower side; a drive motor for rotating the rotor shaft; a rotor fixed to the rotor shaft and formed of a multiple cylinder having a plurality of cylinders with different diameters arranged concentrically with respect to the rotor shaft center; and a thread-groove pump mechanism portion including the plurality of cylinders of the rotor, a stator formed of a multiple cylinder having a plurality of cylinders alternately located between the cylinders and fixed in the pump case, and thread grooves cut in the walls of the stator facing the cylindrical surfaces of the rotor; wherein the gaps defined by the outer walls of the cylinders of the rotor and the stator walls and the gaps defined by the inner walls of the cylinders of the rotor and the stator walls are formed so as to increase with the distance from the rotor shaft center, and the gaps defined by the outer walls of the cylinders of the rotor and the stator walls are formed larger than gaps defined by the inner walls of the cylinders of the rotor and the stator walls.

In the vacuum pump according to the present invention, preferably, the gaps defined by the walls of the cylinders of the rotor and the stator walls are larger at the end of the rotor cylinders than at the base, and the mean value of the gap at the base of the rotor cylinders and the gap at the end of the rotor cylinders increases with the distance from the rotor shaft center.

In the vacuum pump according to the present invention, preferably, the gaps defined by the outer walls of the cylinders of the rotor and the inner walls of the stator are larger at the end of the rotor cylinders than at the base, and the gaps defined by the inner walls of the cylinders of the rotor and the outer walls of the stator are smaller at the end of the rotor cylinders than at the base.

The rotor may be formed of two members that are an inner cylindrical rotor having an inside diameter to surround a stator column and an outer cylindrical rotor having an inside diameter to surround the inner cylindrical rotor.

A mounting structure for the rotor and the rotor shaft may be a structure in which a disk-shaped mounting section of the inner cylindrical rotor is superposed to the lower surface of the collar of the rotor shaft and integrally fastened in the axial direction of the rotor shaft, and a disk-shaped mounting section of the outer cylindrical rotor is superposed to the upper surface of the collar of the rotor shaft and fastened in the axial direction of the rotor shaft.

The rotor may have a stage at the lower end of a cylindrical rotor body fastened in the axial direction of the rotor shaft, the stage having a small-diameter cylinder joined thereto, and a large-diameter cylinder is joined to the outer wall of the lower end of the rotor body.

The thread-groove pump mechanism portion may have thread grooves in the plurality of cylinder walls of the rotor and the stator walls having a flat cylindrical surface.

The pump case may further comprise therein a turbo-molecular pump mechanism portion including a plurality of rotor blades integrally provided on the outermost wall of the multiple cylinder of the rotor and a plurality of stator blades alternately located between the rotor blades and fixed in the pump case.

BRIEF DESCRIPTION OF THE DRABLADES

DESCRIPTION OF THE PREFERRED EMBODIMENTS

Referring to the attached drawings, preferred embodiments of a vacuum pump according to the present invention will be specifically described hereinbelow.

Figure 1:
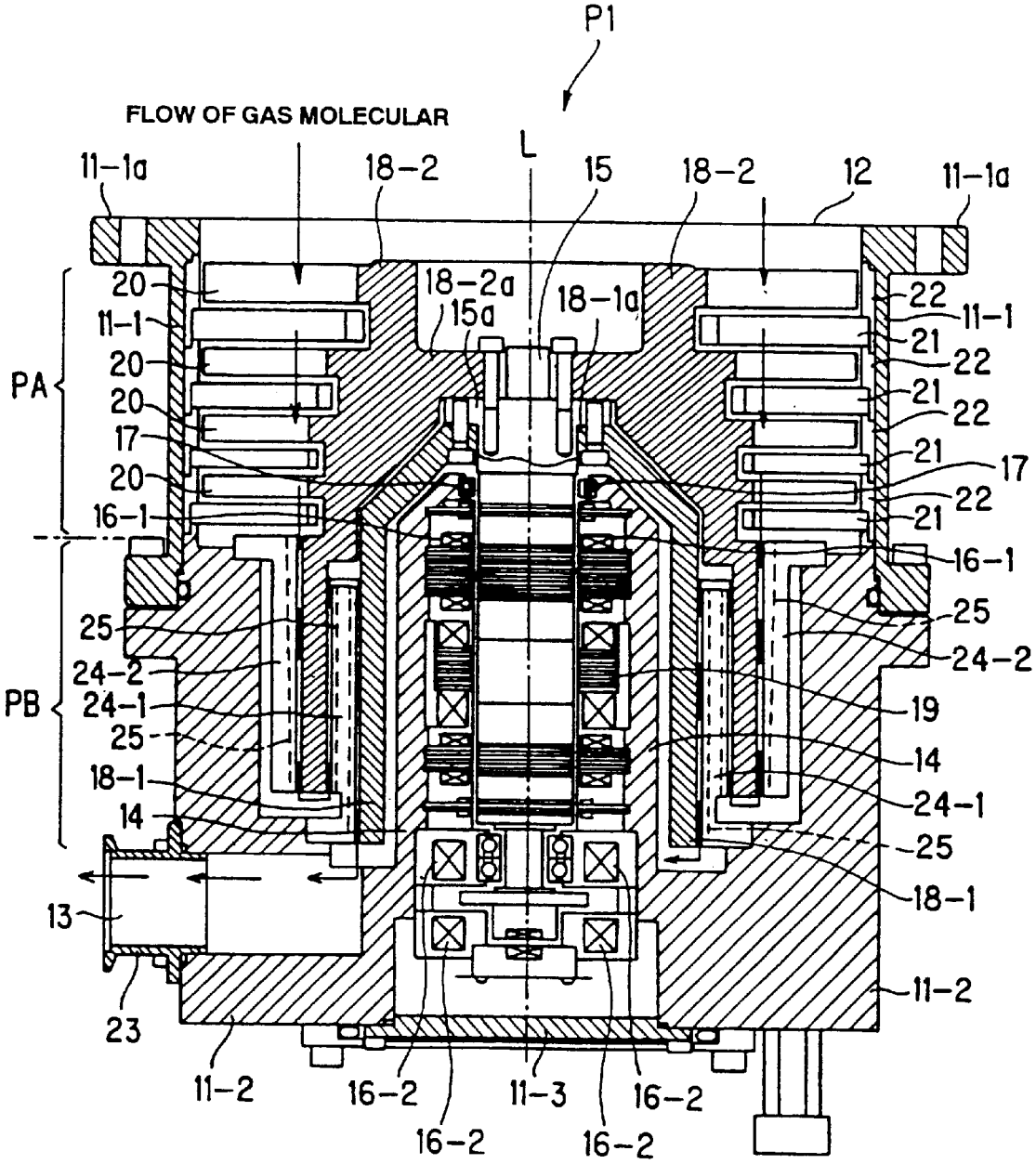
FIG. 1 is a longitudinal sectional view of a first embodiment of a vacuum pump according to the present invention.

FIG. 1 is a longitudinal sectional view of a first embodiment of a vacuum pump according to the present invention. As shown in FIG. 1, a pump mechanism portion of a vacuum pump P1 employs a compound-type pump mechanism constituted by a turbo-molecular pump mechanism portion PA and a thread-groove pump mechanism portion PB accommodated in a pump case 11.

The pump case 11 is composed of a cylinder 11-1 and a base member 11-2 mounted at the lower end thereof. The upper surface of the pump case 11 is opened and serves as a gas suction port 12. To the gas suction port 12, a vacuum vessel such as a process chamber (not shown) is fixed to a flange 11-1*a* of the pump case 11 with a bolt. The lower side surface of the pump case 11 has a gas exhaust port 13, to which a gas exhaust pipe 23 is mounted.

The lower bottom of the pump case 11 is covered with a back cover 11-3, above which a stator column 14 being provided so as to be erected toward the inside of the pump case 11 is fixed to the base member 11-2. The stator column 14 has a rotor shaft 15 that passes through the end faces rotatably journaled by a radial electromagnet 16-1 and an axial electromagnet 16-2, which are provided in the stator column 14, in the radial and axial directions of the rotor shaft 15. A ball bearing 17 coated with a dry lubricant prevents the contact between the rotor shaft 15 and the electromagnets 16-1 and 16-2 to support the rotor shaft 15 at the power failure of a magnetic bearing composed of the radial electromagnet 16-1 and the axial electromagnet 16-2, being in non-contact with the rotor shaft 15 in normal operation.

A rotor 18 mounted to the rotor shaft 15 employs a structure of a multiple cylinder having a plurality of cylinders with different diameters arranged concentrically with respect to the rotor shaft center L. More specifically, the rotor 18 of this embodiment is constituted by two members: an inner cylindrical rotor 18-1 having an inner diameter to surround the stator column 14; and an outer cylindrical rotor 18-2 having an inner diameter to surround the inner cylindrical rotor 18-1. For the inner cylindrical rotor 18-1, a disk-shaped mounting section 18-1*a* is superposed and fixed to the lower surface of a collar 15*a* of the rotor shaft 15 in the axial direction of the rotor shaft 15 with bolts. For the outer cylindrical rotor 18-2, a disk-shaped mounting section 18-2*a* is superposed and fixed to the upper surface of the collar 15*a* of the rotor shaft 15 in the axial direction of the rotor shaft 15 with bolts. When the rotor shaft 15 is rotated at high speed with a drive motor 19 including a high-frequency motor assembled in the stator column 14, the inner cylindrical rotor 18-1 and the outer cylindrical rotor 18-2 are synchronized with the rotor shaft 15 to rotate on the concentric circle of the rotor shaft center L.

Since the outer cylindrical rotor 18-2 has rotor blades, which will be described later, it is preferably made of light alloy such as relatively soft and processible aluminium alloy having a high specific tensile strength. On the other hand, the inner cylindrical rotor 18-1 may be made of a different type of materials such as a carbon resin and a stainless steel in addition to the aluminium alloy because of its relatively simple structure.

Figure 2:
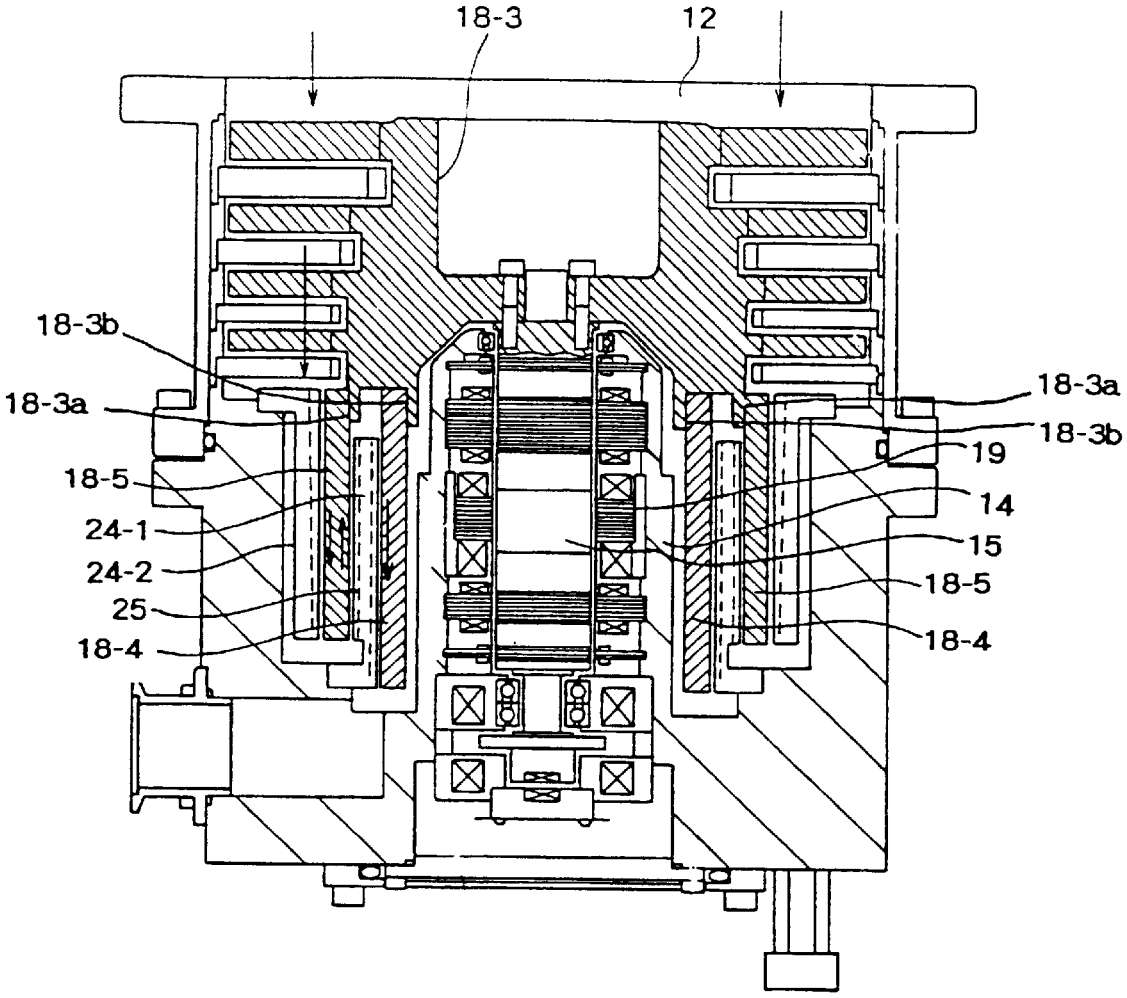
FIG. 2 is a longitudinal sectional view of another example of a rotor mounting structure of the vacuum pump.

The mounting structure for the rotor 18 and the rotor shaft 15 is not limited to the above example, but may employ, for example, another structure in which the disk-shaped mounting section 18-1*a* of the inner cylindrical rotor 18-1 and the disk-shaped mounting section 18-2*a* of the outer cylindrical rotor 18-2 are superposed and fixed to the collar 15*a* of the rotor shaft 15 in the axial direction of the rotor shaft 15 with the same bolts. As shown in FIG. 2, a cylindrical rotor body 18-3 fixed to the rotor shaft 15 in the axial direction with screws may have a stage 18-3*b* at the lower end thereof, to which a small-diameter cylinder 18-4 may be joined, and to an outer wall 18-3*a* at the lower end of the rotor body 18-3, a large-diameter cylinder 18-5 may be joined by adhesive bonding or shrinkage fitting. The mounting structure for the rotor 18 and the rotor shaft 15 have only to be constructed such that the multiple cylinder having the inner cylindrical rotor 18-1 and the outer cylindrical rotor 18-2 and the rotor shaft 15 can rotate on the concentric circle with the rotor shaft center L as the center without eccentricity.

The outermost wall of the multiple cylinder, that is, the outer wall of the outer cylindrical rotor 18-2 of this embodiment integrally has a plurality of rotor blades 20 from the gas suction port 12 toward the rotor shaft center L. A plurality of stator blades 21 alternately located between the rotor blades 20 is fixed to the inner wall of the pump case 11 via spacers 22. The rotor blades 20 and the stator blades 21 constitute the turbo-molecular pump mechanism portion PA for feeding gas molecules near the gas suction port 12 toward the lower blades by the interaction thereof.

The turbo-molecular pump mechanism portion PA has the thread-groove pump mechanism portion PB thereunder. The structure of the thread-groove pump mechanism portion PB will be described hereinbelow.

Figure 3:
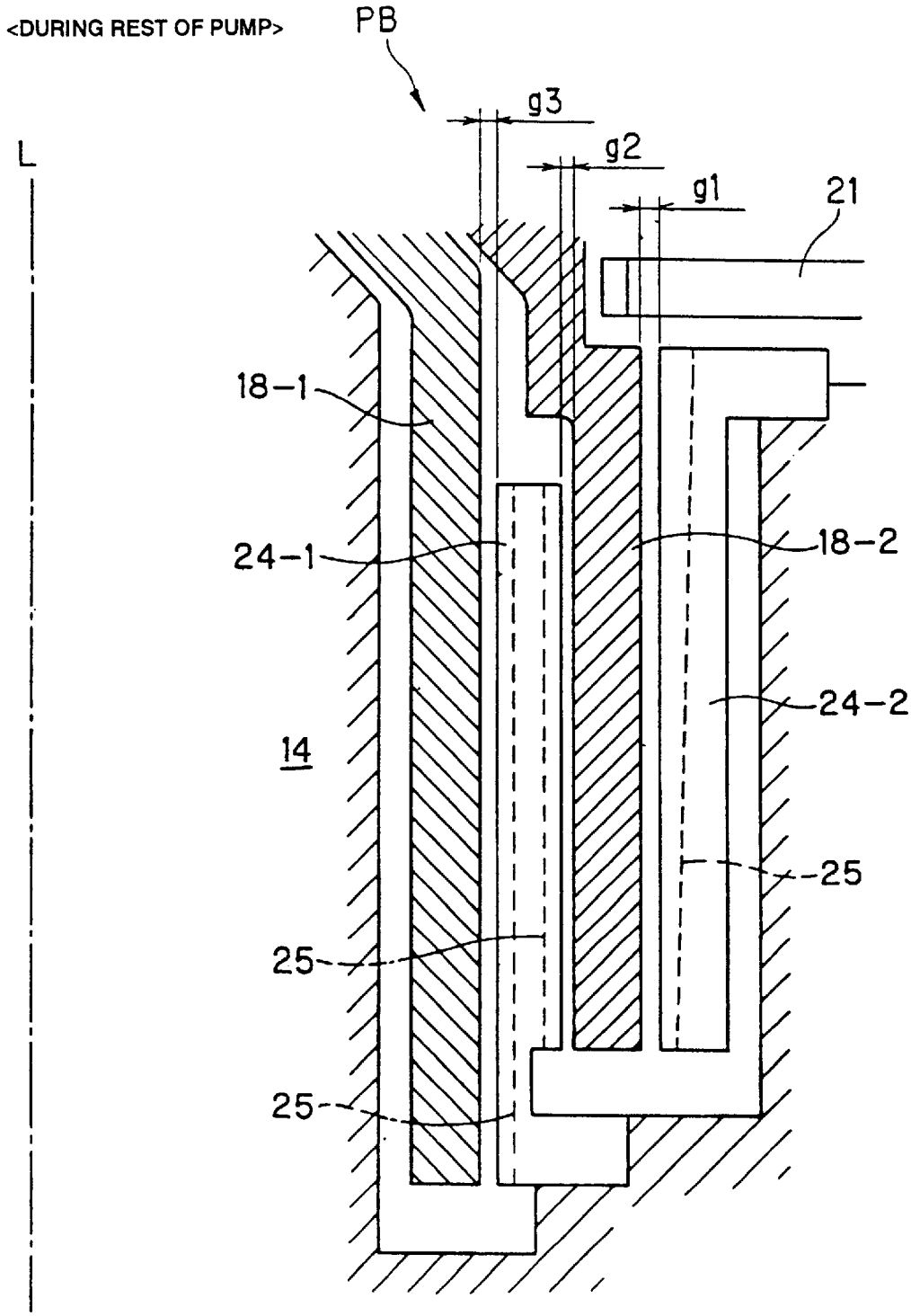
FIG. 3 is an enlarged sectional view of an essential part of an example of a vacuum pump in a stationary state.

As shown in FIGS. 1 to 3, the thread-groove pump mechanism portion PB is constituted by the foregoing multiple cylinder rotating at high speed including the inner cylindrical rotor 18-1 and the outer cylindrical rotor 18-2, and an inner cylindrical stator 24-1 and an outer cylindrical stator 24-2 alternately located between the cylinders of the multiple cylinder. The thread-groove pump mechanism portion PB adopts a turn-back structure of the inner and outer cylindrical rotors 18-1 and 18-2 of the multiple rotor and the inner and outer cylindrical stators 24-1 and 24-2 facing thereto.

The inner and outer walls of the inner cylindrical rotor 18-1 and the inner and outer walls of the outer cylindrical rotor 18-2 form a flat cylindrical surface. On the other hand, a stator 24 mounted to the base member 11-2 in the pump case 11 with a predetermined gap between the cylindrical surface has grooves 25, which are indicated by dotted lines in the drawing, in the inner wall of the outer cylindrical stator 24-2 facing the outer wall of the outer cylindrical rotor 18-2, the outer wall of the inner cylindrical stator 24-1 facing the inner wall of the outer cylindrical rotor 18-2, and the inner wall of the inner cylindrical stator 24-1 facing the outer wall of the inner cylindrical rotor 18-1.

The thread-groove pump mechanism portion PB in this embodiment is constructed such that the gaps defined by the walls of the cylinders of the rotor 18 and the walls of the stator 24, that is, the gaps defined by the outer walls of the cylinders of the rotor 18 and the walls of the stator 24 and the gaps defined by the inner walls of the cylinders of the rotor 18 and the walls of the stator 24 are increased with the distance from the rotor shaft center L, and the gaps defined by the outer walls of the cylinder of the rotor 18 and the walls of the stator 24 are larger than the gaps defined by the inner walls of the cylinders of the rotor 18 and the walls of the stator 24.

More specifically, as shown in FIG. 3, the interrelationship among the gaps g1, g2, and g3 satisfies the conditions g1>g2, and g1>g3, in other words, the gaps increase with the distance from the rotor shaft center L, where, at the rest of the pump, the gap defined by the outer wall of the outer cylindrical rotor 18-2 and the inner wall of the outer cylindrical stator 24-2 facing thereto is g1, the gap defined by the inner wall of the outer cylindrical rotor 18-2 and the outer wall of the inner cylindrical stator 24-1 facing thereto is g2, and the gap defined by the outer wall of the inner cylindrical rotor 18-1 and the inner wall of the inner cylindrical stator 24-1 facing thereto is g3.

Figure 4:
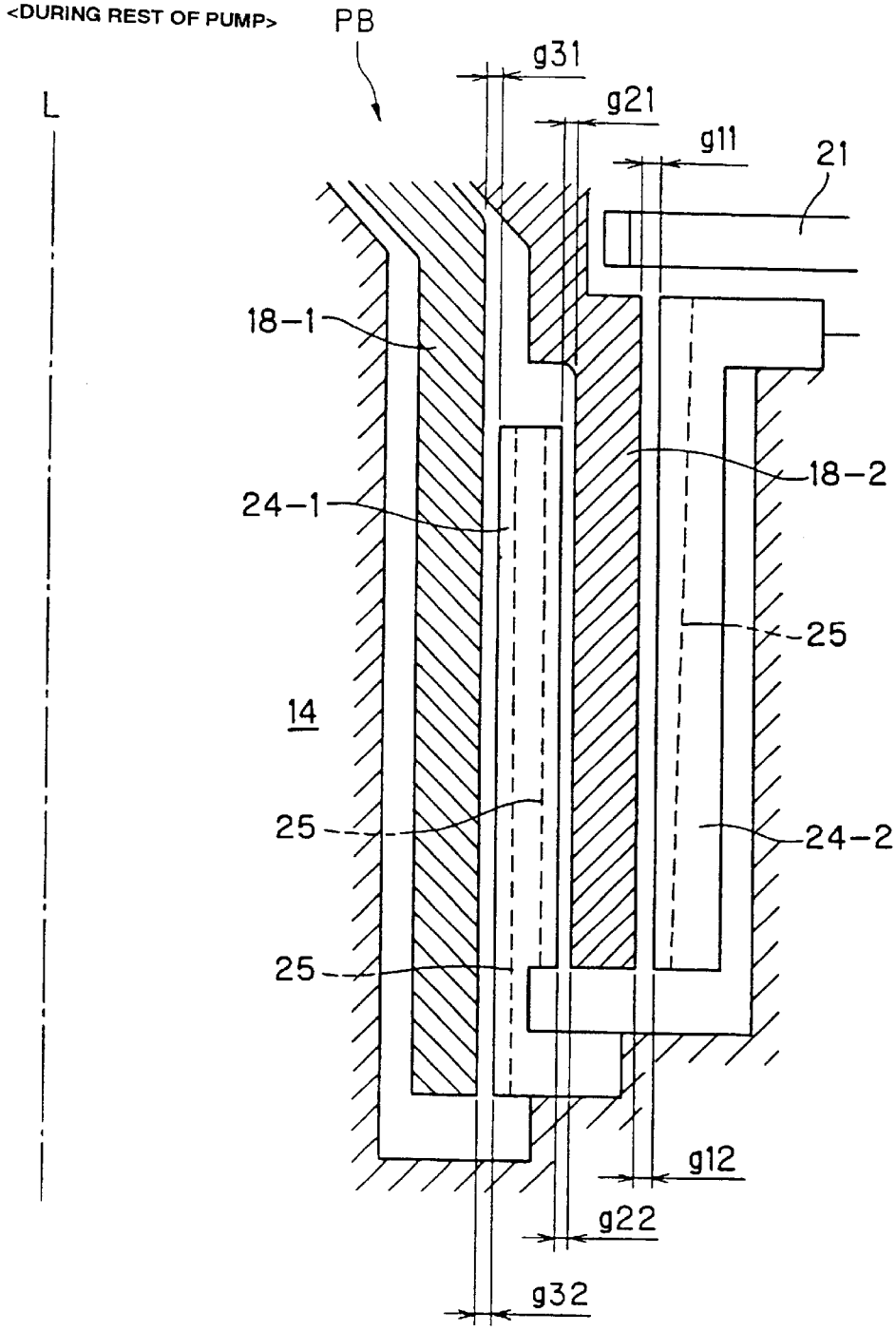
FIG. 4 is an enlarged sectional view of an essential part of another example of a vacuum pump in a stationary state.

Here, the mean value of the gap at the base of the cylinder of the rotor 18 and the gap at the end is increased with the distance from the rotor shaft center L so that the gaps defined by the walls of the rotor 18 and the walls of the stator 24 large at the end of the rotor 18. More specifically, referring to FIG. 4, at the rest of the pump, (g11+g12)/2>(g21+g22)/2, (g11+g12)/2>(g31+g32)/2 should be satisfied, where the base-side gap defined by the outer wall of the outer cylindrical rotor 18-2 and the inner wall of the outer cylindrical stator 24-2 is g11 and the end-side gap is g12, the base-side gap defined by the inner wall of the outer cylindrical rotor 18-2 and the outer wall of the inner cylindrical stator 24-1 is g21 and the end-side gap is g22, and the base-side gap defined by the outer wall of the inner cylindrical rotor 18-1 and the inner wall of the inner cylindrical stator 24-1 is g31, and the end-side gap is g32.

As described above, the reason why the gaps defined by the walls of the rotor 18 and the walls of the stator 24 are formed so as to be increased with the distance from the rotor shaft center L is as follows: The rotor 18 formed of the multiple cylinder integrated with the rotor shaft 15 is displaced by the centrifugal force of the high-speed rotation during the operation of the pump. The displacement of the rotor 18 is larger at the cylinder (the inner cylindrical rotor 18-1 in this embodiment) closest to the rotor shaft center L than at the cylinder (the outer cylindrical rotor 18-2 in this embodiment) farthermost thereto. Accordingly, by increasing the gaps defined by the walls of the cylinders of the rotor 18 and the walls of the stator 24 with the distance from the rotor shaft center L, predetermined clearances at the gap g1, g2, and g3 defined by the walls of the cylinders of the rotor 18 and the walls of the stator 24 can be provided to prevent the contact between the cylinders of the rotor 18 and the stator 24 while keeping the sealing performance thereof even when the rotor 18 is displaced by a centrifugal force or thermal expansion during the operation of the pump.

According to the vacuum pump of this embodiment with the foregoing arrangement, when the rotor shaft 15 is rotated at high speed with the drive motor 19, the multiple cylinder constituted by the inner cylindrical rotor 18-1 and the outer cylindrical rotor 18-2 integrated therewith is rotated at high speed on the concentric circle around the rotor shaft center L, inhales a gas through the gas suction port 12, as shown by the arrow in FIG. 1, and feeds the gas molecules at the high-vacuum gas suction port 12 to the thread-groove pump mechanism portion PB by the interaction between the rotor rotating at high speed blades 20 and the fixed stator blades 21. In the thread-groove pump mechanism portion PB, the gas molecules fed from the turbo-molecular pump mechanism portion PA by the interactions between the outer wall of the high-speed outer cylindrical rotor 18-2 and the inner wall of the outer cylindrical stator 24-2, the inner wall of the outer cylindrical rotor 18-2 and the outer wall of the inner cylindrical stator 24-1, and the outer wall of the inner cylindrical rotor 18-1 and the inner wall of the inner cylindrical stator 24-1 are fed toward the gas exhaust port 13 along the thread grooves 25, thereby exhausting a somewhat low-vacuum gas. Particularly, the thread-groove pump mechanism portion PB employs a turn-back structure with the multiple inner and outer cylindrical rotors 18-1 and 18-2 and the multiple inner and outer cylindrical stators 24-1 and 24-2 facing thereto. Therefore, a longer flow channel of the gas molecules can be provided and back flow of the molecules can be prevented while keeping sealing performance to increase the compressibility of the pump; thus, a decrease in the compressibility of the whole pump can be prevented even when the backing pressure of the rotor blades 20 increases.

Also, the thread-groove pump mechanism portion PB employs a structure in which the gaps defined by the walls of the cylinders of the rotor 18 and the walls of the stator 24 increase with the distance from the rotor shaft center L. Therefore, predetermined clearances can be provided even during the operation of the pump, thereby preventing damage due to the contact between the cylinders of the rotor 18 and the stator 24.

Figure 5:
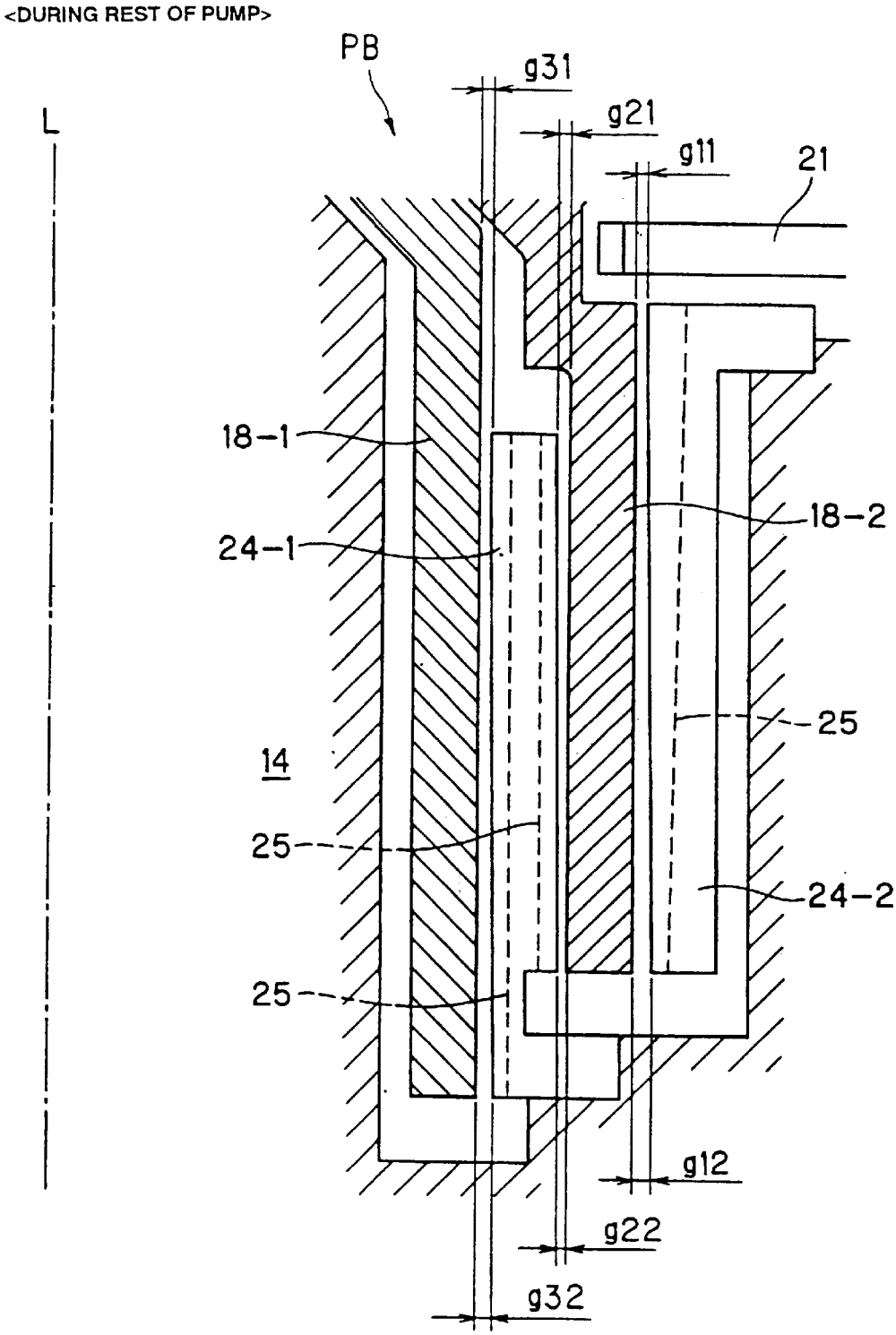
FIG. 5 is an enlarged sectional view of an essential part of a second embodiment of a vacuum pump according to the present invention.

Referring to FIG. 5, a second embodiment of a vacuum pump according to the present invention will be described. Since the principle structure of the vacuum pump of this embodiment is similar to that of the foregoing first embodiment, a description of duplicate parts will be omitted and only different parts will be described here.

In a vacuum pump P2 of this embodiment, the thread-groove pump mechanism portion PB is constructed such that the gaps between the outer walls of the rotor and the inner walls of the stator among the gaps defined by the walls of the cylinders of the rotor and the walls of the stator at the rest of the pump are larger at the end of the rotor than at the base, and the gaps between the inner walls of the rotor and the outer walls of the stator are smaller at the end of the rotor than at the base.

More specifically, as shown in FIG. 5, at the rest of the pump, the base-side gap defined by the outer wall of the outer cylindrical rotor 18-2 and the inner wall of the outer cylindrical stator 24-2 is g11 and the end-side gap is g12, the base-side gap defined by the inner wall of the outer cylindrical rotor 18-2 and the outer wall of the inner cylindrical stator 24-1 is g21 and the end side gap is g22, and the base-side gap defined by the outer wall of the inner cylindrical rotor 18-1 and the inner wall of the inner cylindrical stator 24-1 is g31, and the end-side gap is g32. Where the gaps between the outers wall of the rotor 18 and the inner walls of the stator 24 are larger at the end of the rotor 18 than at the base, that is, g11<g12 and g31<g32 should be satisfied; and the gaps between the inner walls of the rotor 18 and the outer walls of the stator 24 are smaller at the end of the rotor 18 than at the base, in other words, g21>g22 should be satisfied. The difference between the gap at the base and the gap at the end is preferably set to approximately 0.1 to 0.5 mm which is equal to the displacement of the rotor 18 during the operation of the pump.

As described above, the reason why the gaps between the outer walls of the rotor 18 and the inner walls of the stator 24 are formed so as to be larger at the end of the rotor 18 than at the base thereof, and the gaps between the inner walls of the rotor 18 and the outer walls of the stator 24 are smaller at the end of the rotor 18 than at the base is as follows: The rotor 18 formed of the multiple cylinder integrated with the rotor shaft 15 is displaced by the centrifugal force of the high-speed rotation during the operation of the pump; the displacement of the rotor 18 is larger at the cylinder (the inner cylindrical rotor 18-1 in this embodiment) closest to the rotor shaft center L than at the cylinder (the outer cylindrical rotor 18-2 in this embodiment) farthermost thereto; and the displacement of the rotor 18 at the end is larger than that at the base and increases with the distance from the rotor shaft center L.

Accordingly, the gaps between the outer walls of the rotor 18 and the inner walls of the stator 24 are formed so as to be larger at the end of the rotor 18 than at the base, and the gaps between the inner walls of the rotor 18 and the outer walls of the stator 24 are smaller at the end of the rotor 18 than at the base. Thus, predetermined gaps defined by the walls of the cylinders of the rotor 18 and the walls of the stator 24 can be provided to prevent the contact between the cylinders of the rotor 18 and the stator 24 while keeping the sealing performance thereof even when the rotor 18 is displaced by a centrifugal force or thermal expansion during the operation of the pump. Consequently, similar effects to those of the first embodiment can be provided.

In the foregoing embodiments, examples of a thread-groove pump mechanism portion PB in which the plurality of cylinder walls of the rotor 18 has a flat cylindrical surface and each of the walls of the stator 24 facing thereto has the groove 25 were described; however, on the other hand, each cylinder wall of the rotor 18 may have the groove 25 and the walls of the stator 24 facing thereto may have a flat cylindrical surface. The same effects as in the foregoing embodiments can be expected by the interaction between the thread grooves 25 in the cylinder walls and the cylinder walls of the stator 24.

As described in detail, according to the vacuum pump of the present invention, particularly, the thread-groove pump mechanism portion employs a turn-back structure including a rotor formed of a multiple cylinder and a stator formed of a multiple cylinder facing thereto, wherein the gaps defined by the cylinder walls of the rotor and the cylinder walls of the stator during the rest of the pump increase with the distance from the rotor shaft center. Consequently, a reliable vacuum pump can be provided in which, even during the operation of the pump, predetermined clearances can be provided to prevent damage due to the contact between the rotor and the stator, a longer flow channel of the gas molecules can be provided, and back flow of the molecules can be prevented while keeping sealing performance to increase the compressibility; thus, a decrease in the compressibility of the whole pump can be prevented even when the backing pressure of the rotor blades increases.

What is claimed is:

1. A vacuum pump comprising:

a rotor shaft rotatably supported in a pump case having a gas suction port opened in the upper surface and a gas exhaust port opened in the lower side;

a drive motor for rotating the rotor shaft;

a rotor fixed to the rotor shaft and formed of a multiple cylinder having a plurality of cylinders with different diameters arranged concentrically with respect to the rotor shaft center; and a thread-groove pump mechanism portion including the plurality of cylinders of the rotor, a stator formed of a multiple cylinder having a plurality of cylinders alternately located between the cylinders and fixed in the pump case, and a thread groove cut in a wall of the stator facing the cylindrical surfaces of the rotor; wherein gaps defined by the outer walls of the cylinders of the rotor and the stator walls and a gap defined by the inner walls of the cylinders of the rotor and the stator walls are formed so as to increase with the distance from the rotor shaft center, and the gaps defined by the outer walls of the cylinders of the rotor and the stator walls are formed larger than gaps defined by the inner walls of the cylinders of the rotor and the stator walls.

2. A vacuum pump according to claim 1, wherein the pump case further comprises therein a turbo-molecular pump mechanism portion including a plurality of rotor blades integrally provided on the outermost wall of the multiple cylinder of the rotor and a plurality of stator blades alternately located between the rotor blades and fixed in the pump case.

3. A vacuum pump according to claim 1, wherein:

the gaps defined by the walls of the cylinders of the rotor and the stator walls are larger at the end of the rotor cylinders than at the base, and the mean value of the gap at the base of the rotor cylinders and the gap at the end of the rotor cylinders increases with the distance from the rotor shaft center.

4. A vacuum pump according to claim 3, wherein the pump case further comprises therein a turbo-molecular pump mechanism portion including a plurality of rotor blades integrally provided on the outermost wall of the multiple cylinder of the rotor and a plurality of stator blades alternately located between the rotor blades and fixed in the pump case.

5. A vacuum pump according to claim 1, wherein:

the gaps defined by the outer walls of the cylinders of the rotor and the inner walls of the stator are larger at the end of the rotor cylinders than at the base, and the gaps defined by the inner walls of the cylinders of the rotor and the outer walls of the stator are smaller at the end of the rotor cylinders than at the base.

6. A vacuum pump according to claim 5, wherein the pump case further comprises therein a turbo-molecular pump mechanism portion including a plurality of rotor blades integrally provided on the outermost wall of the multiple cylinder of the rotor and a plurality of stator blades alternately located between the rotor blades and fixed in the pump case.

7. A vacuum pump according to claim 1, wherein:

the rotor has a stage at the lower end of a cylindrical rotor body fastened in the axial direction of the rotor shaft, the stage having a small-diameter cylinder joined thereto, and a large-diameter cylinder is joined to the outer wall of the lower end of the rotor body.

8. A vacuum pump according to claim 7, wherein the pump case further comprises therein a turbo-molecular pump mechanism portion including a plurality of rotor blades integrally provided on the outermost wall of the multiple cylinder of the rotor and a plurality of stator blades alternately located between the rotor blades and fixed in the pump case.

9. A vacuum pump according to claim 1, wherein:

the thread-groove pump mechanism portion has thread grooves in the plurality of cylinder walls of the rotor and the stator walls having a flat cylindrical surface.

10. A vacuum pump according to claim 9, wherein the pump case further comprises therein a turbo-molecular pump mechanism portion including a plurality of rotor blades integrally provided on the outermost wall of the multiple cylinder of the rotor and a plurality of stator blades alternately located between the rotor blades and fixed in the pump case.

11. A vacuum pump according to claim 1, wherein:

the rotor is formed of two members that are an inner cylindrical rotor having an inside diameter to surround a stator column and an outer cylindrical rotor having an inside diameter to surround the inner cylindrical rotor.

12. A vacuum pump according to claim 11, wherein the pump case further comprises therein a turbo-molecular pump mechanism portion including a plurality of rotor blades integrally provided on the outermost wall of the multiple cylinder of the rotor and a plurality of stator blades alternately located between the rotor blades and fixed in the pump case.

13. A vacuum pump according to claim 11, wherein:

a mounting structure for the rotor and the rotor shaft is a structure in which a disk-shaped mounting section of the inner cylindrical rotor is superposed to the lower surface of the collar of the rotor shaft and integrally fastened in the axial direction of the rotor shaft, and a disk-shaped mounting section of the outer cylindrical rotor is superposed to the upper surface of the collar of the rotor shaft and integrally fastened in the axial direction of the rotor shaft.

14. A vacuum pump according to claim 13, wherein the pump case further comprises therein a turbo-molecular pump mechanism portion including a plurality of rotor blades integrally provided on the outermost wall of the multiple cylinder of the rotor and a plurality of stator blades alternately located between the rotor blades and fixed in the pump case.

15. A vacuum pump according to claim 11, wherein:

a mounting structure for the rotor and the rotor shaft is a structure in which a disk-shaped mounting section of the inner cylindrical rotor is superposed to a disk-shaped mounting section of the outer cylindrical rotor and integrally fastened to the collar of the rotor shaft in the axial direction of the rotor shaft.

16. A vacuum pump according to claim 15, wherein the pump case further comprises therein a turbo-molecular pump mechanism portion including a plurality of rotor blades integrally provided on the outermost wall of the multiple cylinder of the rotor and a plurality of stator blades alternately located between the rotor blades and fixed in the pump case.

* * * * *